United States Patent [19]

Johnston

[11] Patent Number: 4,821,786

[45] Date of Patent: Apr. 18, 1989

[54] REELABLE DOOR CLOSURE

[76] Inventor: Bernard A. Johnston, 3026 Fairfield Ave., Downers Grove, Ill. 60515

[21] Appl. No.: 92,949

[22] Filed: Sep. 4, 1987

[51] Int. Cl.[4] ..... E06B 9/08; E06B 9/20

[52] U.S. Cl. ..... 160/23.1; 16/78; 16/95 R; 160/26

[58] Field of Search ..... 16/78, 61, 63, 320, 16/DIG. 14; 160/23.1, 26, 32, 33, 133, 270

[56] References Cited

U.S. PATENT DOCUMENTS

| | | | |
|---|---|---|---|
| 514,966 | 2/1894 | Schluns | 160/23.1 X |
| 541,696 | 6/1895 | Spaulding | 160/23.1 X |
| 832,335 | 10/1906 | McDonald | 160/264 |
| 1,109,744 | 9/1914 | Emery | 160/290.1 |
| 1,217,210 | 2/1917 | Packer | 160/23.1 |
| 1,371,149 | 3/1921 | Dudek | 160/23.1 X |
| 1,527,038 | 2/1925 | Fasson | 160/23.1 |
| 1,608,667 | 11/1926 | Poetsch | 160/23.1 |
| 1,958,695 | 5/1934 | Claus | 160/23.1 |
| 2,015,993 | 10/1935 | Drake | 160/23.1 |
| 3,050,742 | 8/1962 | Munson | 160/23.1 X |
| 3,090,424 | 5/1963 | Carlo | 160/23.1 |
| 3,231,005 | 1/1966 | Cookson et al. | 160/26 |
| 3,244,443 | 4/1966 | Rodgers | 16/82 X |
| 4,317,480 | 3/1982 | Phelps | 160/23.1 |
| 4,458,739 | 7/1984 | Murray et al. | 160/23.1 |
| 4,511,211 | 4/1985 | Runyan | 350/117 |
| 4,638,844 | 1/1987 | Hayashiguchi | 160/23.1 |

*Primary Examiner*—Nicholas P. Godici
*Assistant Examiner*—J. Reed Batten, Jr.

[57] ABSTRACT

A closure structure for covering a door opening includes a recoilable spool of closure material, such as plastic or screen cloth, which closure material moves horizontally across a doorway and is stabilized by a top track hanger and a vertically extending locking and stabilizing member secured to the free end of the closure material.

1 Claim, 2 Drawing Sheets

REELABLE DOOR CLOSURE

BACKGROUND AND SUMMARY OF INVENTION

This invention relates to a reelable door closure and, more particularly, to a novel closure adapted to be mounted on one door jam and releasably connected to the other, and adapted for either plastic storm door closure material or screen cloth material.

Over the years, many reelable door closure expedients have been suggested. A search of the art relating to reelable or coilable door closures revealed the following art references:

U.S. Pat. Nos. 832,335; 1,109,744; 1,317,210; 1,371,149; 1,527,038; 1,608,667; 1,958,695; 2,015,993; 3,050,742; 3,090,424; 4,317,480; 4,511,211; Although the foregoing patents show many approaches, none provide the advantages of applicant's invention which has cooperating spool means, locking and stabilizing member means and hanger track means which result in providing a taut, easily reelable/unreelable door closure. Other objects and advantages of the invention may be seen in the details of construction set down in the ensuing specification.

The invention is explained in conjunction with the accompanying drawing in which.

DETAILED DESCRIPTION

Figure 1:
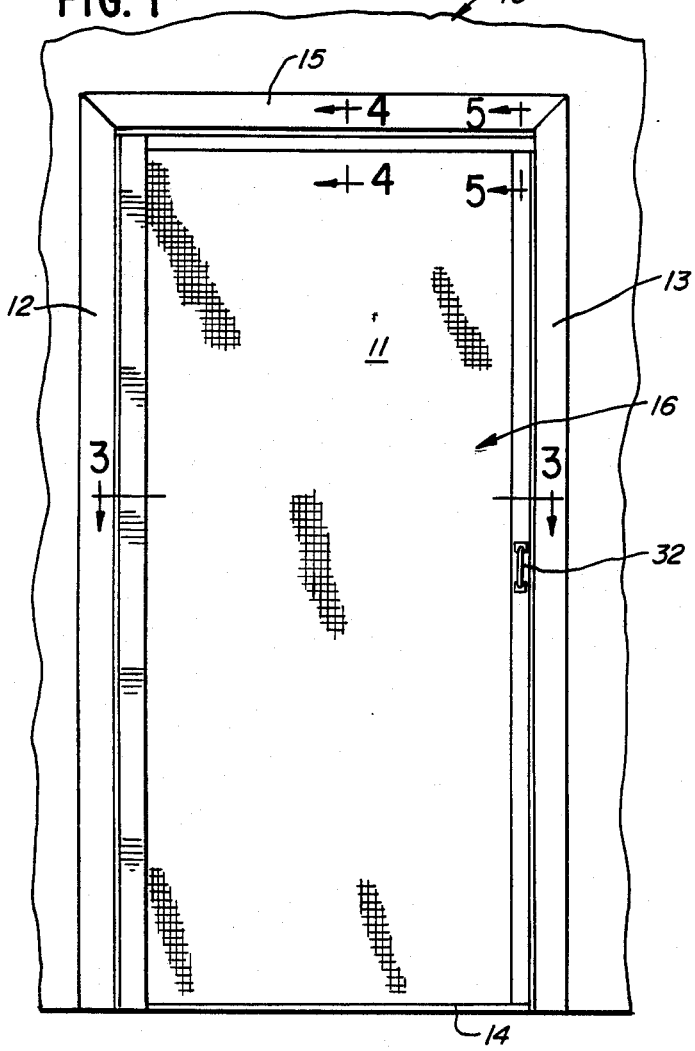
FIG. 1 is a fragmentary front elevational view of a structure featuring a doorway equipped with the inventive closure.

In the illustration given and with reference first to FIG. 1, the numeral 10 designates generally a structure which is equipped with a doorway 11 defined by jambs 12 and 13, a sill 14 and a cross top member 15 connecting the upper ends of the vertically extending, spaced jambs 12 and 13.

Figure 2:
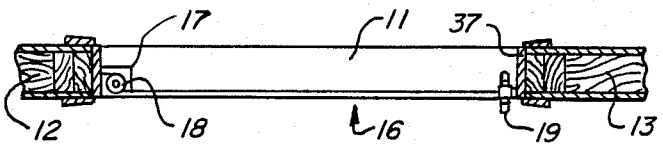
FIG. 2 is a fragmentary top plan view, partially in section, showing the arrangement of FIG. 1.

Closing the doorway 11 is a door closure assembly generally designated 16 and which, from a consideration of FIG. 2, consists essentially of a box-like enclosure 17, a reel of closure material 18 and a locking and stabilizing member 19.

Figure 3:
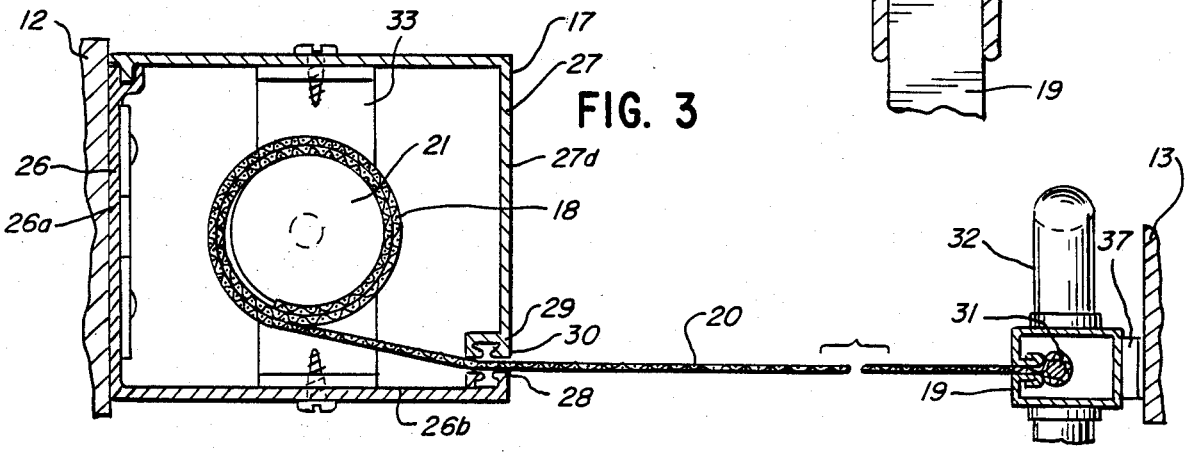
FIG. 3 is an enlarged fragmentary sectional view such as would be seen along the sight line 3—3 of FIG. 1.

These can all be seen in larger scale in FIG. 3 where like numerals are employed to designate like elements, the closure material itself is designated 20 in FIG. 3 and is illustrated as screen cloth. Alternatively, and with equally good results, the closure material which is reeled on the spool 21 may be a vinyl or other plastic suitable for storm door usage.

Figure 4:
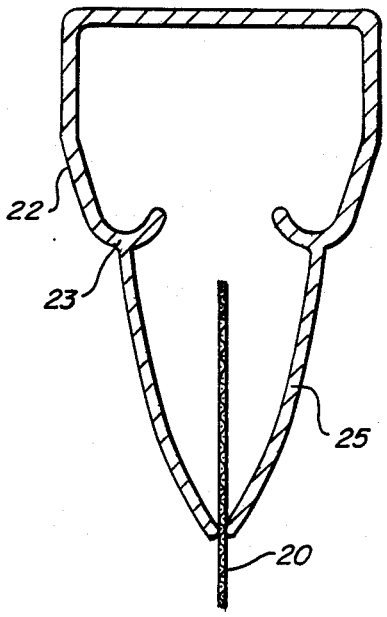
FIG. 4 is an enlarged sectional view taken along the sight line 4—4 of FIG. 1.
Figure 5:
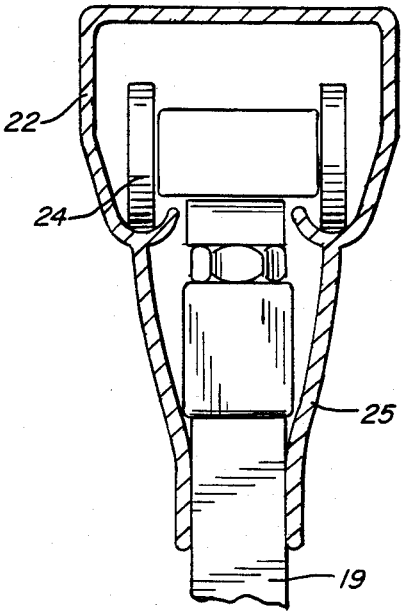
FIG. 5 is an enlarged fragmentary sectional view taken along the sight line 5—5 of FIG. 1.

Also operatively associated with the assembly 16 is a track hanger 22 which can be seen in FIGS. 4 and 5. The track hanger 22 provides guide means as at 23 for supporting wheels 24 provided at the upper end of the locking and stabilizing member 19—see FIG. 5. Also, the track hanger is equipped with a pair of depending horizontally extending tongues 25 which are openable to pass the locking and stabilizing member 19 (see FIG. 5) but which are resiliently closable so as to engage the opposite sides of the closure material 20.

Figure 6:
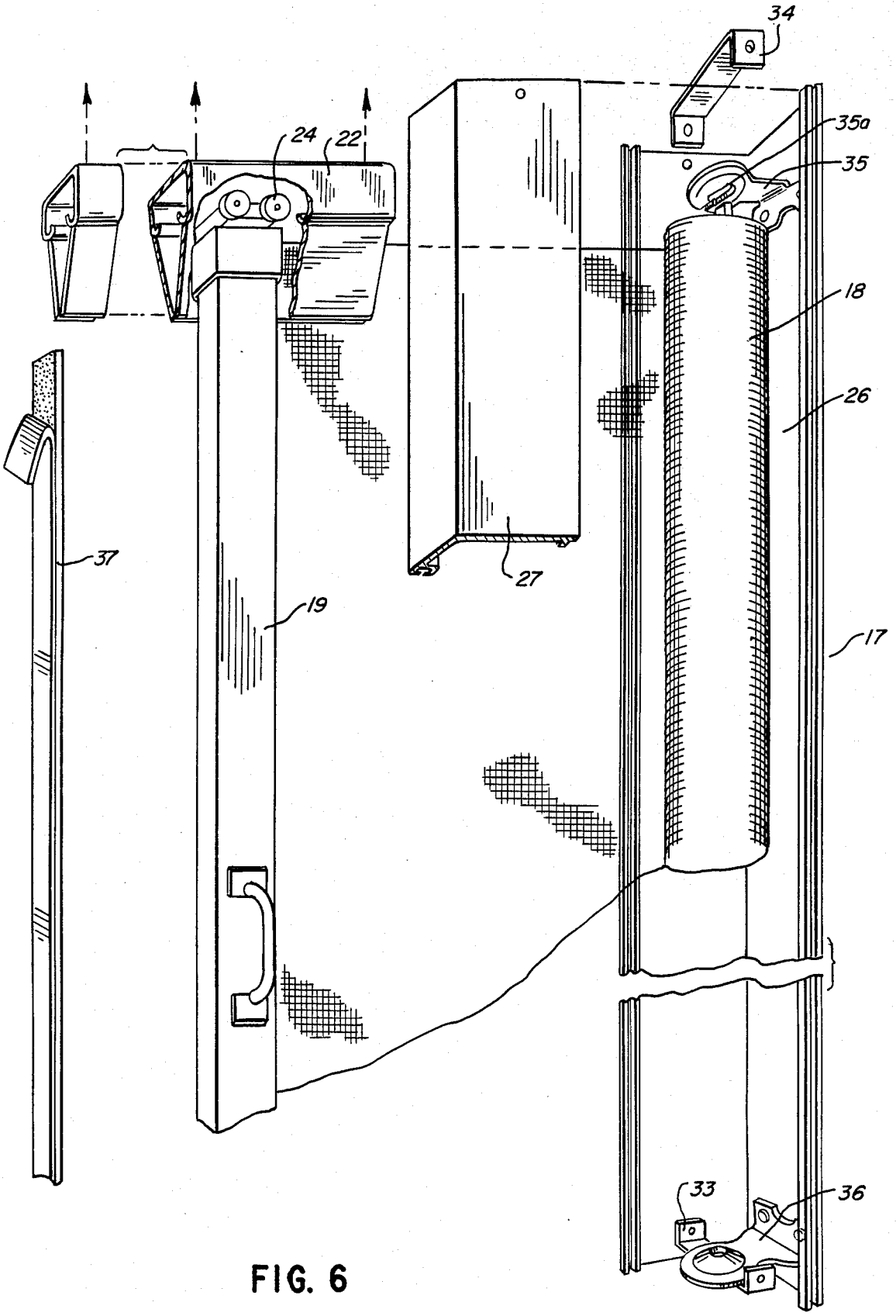
FIG. 6 is an exploded fragmentary perspective view of the various elements constituting the inventive closure.

The track hanger 22 can also be seen in FIG. 6 in perspective, broken away form where it is seen to be supporting four wheels 24 provided atop the member 19. The upper portion of the track hanger 22 is constructed of 0.05" extruded metal while the lower part which provides resiliency is constructed of 0.040" extruded metal. In the right portion of FIG. 6, the component pieces of the box 17 can be seen which include the angle elements 26 and 27.

As can be seen from the left hand portion of FIG. 3, each angle element 26 or 27 has a pair of arm portions. For example, the arm portion 26*a* is attached to the jamb 12 and its second arm portion 26*b* extends toward the jamb 13. At its free end the jamb 26*b* is equipped with rib means as at 28 which cooperate with similar rib means 29 on the arm portion 27*a* of the angle element 27 to provide an opening 30 permitting passage of the closure material 20. The distal end 31 of the closure material 20 is captured within the stabilizing and locking member 19—which is equipped with inner and outer handles as at 32.

Referring again to the left hand portion of FIG. 3, the second angle element 27 is secured to the first angle element 26 by means of a cross bracket 33—see also the lower right hand portion of FIG. 6. In the upper portion of FIG. 6 a corresponding bracket 34 connects the two pieces of the box together.

Additionally, the box 17 is equipped with brackets as at 35 and 36 which releasably support the spool 18. The brackets 35 and 36 can be flexed slightly so as to permit replacement of one type of spool material with another. This makes possible advantageous use in high rise apartment buildings such as those having limited access walk-out balconies so that the closure material can be altered readily.

Referring now to the right hand portion of FIG. 2, it will be seen that there is a strip 37 of magnetic material secured to the jamb 13. This can also be seen in the left hand portion of FIG. 6 which enables the jamb 13 to releasably maintain the closure 16 in closed position. However, if something is thrown at the closure 16, it causes it to disengage from the magnetic style lock and to automatically retract under the spring loading of the spool. However, a hard force will retract it to protect the closure whereas mere high winds will not.

While in the foregoing specification a detailed description of an embodiment of the invention has been set down for the purpose of illustration, many variations in the details hereingiven may be made by those skilled in the art without departing from the spirit and scope thereof.

I claim:

1. The reelable door closure comprising a door frame having spaced apart, vertically extending jambs having inner and outer edges and a cross member top interconnecting said jambs, a vertically elongated box secured to one of said jambs and equipped with upper and lower spool supports, a spool of door closure material reelably mounted in said supports, said box including a first angle element having first and second arm portions, said first arm portion being secured to said one jamb and said second arm portion extending toward the other of said jambs from adjacent the outer edge of said one jamb, said first arm portion having a free edge equipped with rib means defining a slot, said box including a second angle element having third and fourth arm portions cooperating with said first and second arm portions in defining said box, said third arm portion being having a free edge equipped with rib means engaging said slot, said second and fourth arm portions having free ends each equipped with rib means arranged in spaced apart relation to provide a passage for said closure material when being unreeled toward the other of said jambs, a locking and stabilizing member attached to the free end of said closure material and having means cooperable with said other of said jambs for releasable magnetic locking engagement, said locking and stabilizing member being equipped with four wheels at the upper end thereof, a track hanger secured to said cross member top and having opposed internal guide means suspendingly mounting said wheels, said track hanger being equipped with depending tongue portions for engaging said closure material and providing an elongated opening for said closure material to pass whereby said track hanger spool and locking and stabilizing member cooperate to provide a taut, readily operable closure.

* * * * *